US009085947B2

(12) United States Patent
George et al.

(10) Patent No.: US 9,085,947 B2
(45) Date of Patent: Jul. 21, 2015

(54) ROTARY DRILL BIT WITH CUTTING INSERT FOR ENGAGING EARTH STRATA

(71) Applicant: Kennametal Inc., Latrobe, PA (US)

(72) Inventors: Stephen M. George, Greensboro, NC (US); Nicholas J. Paros, Johnstown, PA (US)

(73) Assignee: KENNAMETAL INC., Latrobe, PA (US)

( * ) Notice: Subject to any disclaimer, the term of this patent is extended or adjusted under 35 U.S.C. 154(b) by 193 days.

(21) Appl. No.: 13/871,002

(22) Filed: Apr. 26, 2013

(65) Prior Publication Data

US 2014/0318870 A1 Oct. 30, 2014

(51) Int. Cl.
*E21B 10/58* (2006.01)
*E21B 10/00* (2006.01)

(52) U.S. Cl.
CPC ..... *E21B 10/58* (2013.01); *E21B 10/003* (2013.01)

(58) Field of Classification Search
CPC ..... E21B 10/31; E21B 10/54; E21B 10/58
See application file for complete search history.

(56) References Cited

U.S. PATENT DOCUMENTS

| | | | | |
|---|---|---|---|---|
| 2,689,108 | A | 9/1954 | Haglund | |
| 3,006,424 | A | 10/1961 | Dahlin et al. | |
| 4,189,013 | A | 2/1980 | Adams et al. | |
| 4,550,791 | A | 11/1985 | Isakov | |
| 4,603,751 | A | 8/1986 | Erickson | |
| 4,616,963 | A | 10/1986 | Habert et al. | |
| 4,667,755 | A | 5/1987 | Muller et al. | |
| 4,787,464 | A | 11/1988 | Ojanen | |
| 4,984,944 | A | 1/1991 | Pennington, Jr. et al. | |
| 4,998,574 | A | 3/1991 | Beach et al. | |
| 5,141,367 | A | 8/1992 | Beeghly et al. | |
| 5,172,775 | A | 12/1992 | Sheirer et al. | |
| 5,184,689 | A | 2/1993 | Sheirer et al. | |
| 5,220,967 | A | 6/1993 | Monyak | |
| 5,375,672 | A | 12/1994 | Peay et al. | |
| 5,400,861 | A | 3/1995 | Sheirer | |
| 5,452,628 | A | 9/1995 | Montgomery, Jr. et al. | |
| 5,467,837 | A | 11/1995 | Miller et al. | |
| 5,996,715 | A | 12/1999 | Peay et al. | |
| 6,145,606 | A | 11/2000 | Haga | |
| 6,173,798 | B1 | 1/2001 | Bryant et al. | |
| 6,260,638 | B1 | 7/2001 | Massa et al. | |
| 6,270,297 | B1 * | 8/2001 | Fang et al. | 408/227 |
| 6,595,305 | B1 | 7/2003 | Dunn et al. | |
| 6,860,344 | B2 | 3/2005 | Bise et al. | |

(Continued)

*Primary Examiner* — William P Neuder
(74) *Attorney, Agent, or Firm* — Larry R. Meenan

(57) ABSTRACT

A rotary drill bit for engaging an earth strata material includes a cutting insert attached to an axial forward end of an elongate drill bit body. The cutting insert includes an elongate insert body rotatable about a central axis with a pair of symmetrical halves symmetrical about the central axis, each symmetrical half comprising: a leading face; a top surface having a primary relief surface; a web thinning gash extending between the leading face and the primary relief surface, the web thinning gash having a debris evacuation portion centrally disposed adjacent the central axis and a distal transition portion disposed adjacent the debris evacuation portion; a first leading cutting edge at the intersection of the leading face and the primary relief surface; and a second leading cutting edge at the intersection of the web thinning gash and the primary relief surface of the top surface.

18 Claims, 7 Drawing Sheets

(56) References Cited

U.S. PATENT DOCUMENTS

| | | | | |
|---|---|---|---|---|
| 6,945,340 | B2 | 9/2005 | Bise et al. | |
| 7,168,511 | B2 | 1/2007 | Woods et al. | |
| 8,002,054 | B2 | 8/2011 | Swope et al. | |
| 8,020,591 | B2 | 9/2011 | Kappel et al. | |
| 2006/0065446 | A1* | 3/2006 | Woods et al. | 175/426 |
| 2010/0187019 | A1* | 7/2010 | Swope et al. | 175/427 |
| 2010/0316456 | A1 | 12/2010 | George | |
| 2012/0241223 | A1* | 9/2012 | Bise et al. | 175/428 |

* cited by examiner

ROTARY DRILL BIT WITH CUTTING INSERT FOR ENGAGING EARTH STRATA

BACKGROUND OF THE INVENTION

The invention pertains generally to an excavating tool such as, for example, a rotary drill bit useful for drilling through various earth strata. More specifically, the invention pertains to a rotary drill bit with a cutting insert such as, for example, a roof drill bit useful for drilling bore holes in an underground mine.

The expansion of an underground mine, such as for example, a coal mine, requires digging a tunnel. Initially, this tunnel has an unsupported roof. Because the roof is not supported, there is an increased chance for a mine cave that, of course, adds to the hazards of underground coal mining. Furthermore, an unsupported roof is susceptible to rock and debris falling from the roof. Falling rock and debris can injure workers as well as create hazardous clutter on the floor of the tunnel. In order to support and stabilize the roof in an underground tunnel, bore holes are drilled in the roof, i.e., earth strata.

The apparatus used to drill these holes typically comprises a drill with a long shaft, i.e., drill steel, attached to the drill. A roof drill bit is detachably mounted to the drill steel at the distal end thereof. In certain roof drill bits, a hard cutting insert is mounted on a body of the roof drill bit. The roof drill bit is then pressed against the roof, and the drilling apparatus operated so as to drill a bore hole in the roof. The bore holes extend between about two feet and about twenty feet into the roof depending upon the particular situation. The roof support members, such as roof panels, are then attached to roof bolts. In one alternative procedure, these bore holes are filled with resin and roof bolts are fixed within the bore holes. In another alternative procedure, the roof bolts use mechanical expander shells to affix the roof bolts in the bore holes. The end result of using either procedure is a roof which is supported, and hence, is of much greater stability than the unsupported roof. This reduces the hazards associated with underground mining. The roof bolting process is considered to be an essential underground mining activity.

Roof bolting accounts for the largest number of lost time injuries in underground mining. During the roof bolting process, the roof is unsupported so that it does not have optimum stability. Furthermore, the roof bolting process exerts stresses on the roof so as to further increase the safety hazards during the roof bolting process. Thus, a decrease in the overall time necessary to bore holes reduces the time it takes to complete the roof bolting process. This is desirable since it contributes to the overall speed, efficiency and safety of the roof bolting process. Thus, many solutions have been proposed to decrease the overall time to complete the drilling of the necessary bore holes. For example, roof drilling bits with various cutting inserts and various cutting geometries have been developed.

However, there is still a need for improved roof drilling bits that overcome disadvantages, limitations and shortcomings of known roof drilling bits. For example, it would be desirable to provide an improved roof drill bit that facilitates the prompt completion of the roof bolting process. It would also be desirable to provide an improved roof drill bit that has a longer useful life. It would also be desirable to provide an improved roof drill bit that has an increased penetration rate.

SUMMARY OF THE INVENTION

In accordance with an aspect of the invention, a rotary drill bit for engaging an earth strata material includes an elongate drill bit body having an axial forward end and an axial rearward end, and a cutting insert attached to the axial forward end of the elongate drill bit body, the cutting insert having an elongate insert body rotatable about a central axis. The elongate insert body includes a pair of symmetrical halves symmetrical about the central axis, each symmetrical half comprising: a leading face; a top surface having a primary relief surface; a web thinning gash extending between the leading face and the primary relief surface of the top surface, the web thinning gash having a debris evacuation portion centrally disposed adjacent the central axis and a distal transition portion disposed adjacent the debris evacuation portion; a first leading cutting edge at the intersection of the leading face and the primary relief surface of the top surface; and a second leading cutting edge at the intersection of the web thinning gash and the primary relief surface of the top surface, the second leading cutting edge being continuous with the first leading cutting edge.

In accordance with another aspect of the invention, a cutting insert for use in connection with a rotary drill bit for engaging an earth strata material includes an elongate insert body rotatable about a central axis. The elongate insert body includes a pair of symmetrical halves symmetrical about the central axis, each symmetrical half comprising: a leading face; a top surface having a primary relief surface; a web thinning gash extending between the leading face and the primary relief surface of the top surface, the web thinning gash having a debris evacuation portion centrally disposed adjacent the central axis and a distal transition portion disposed adjacent the debris evacuation portion; a first leading cutting edge at the intersection of the leading face and the primary relief surface of the top surface; and a second leading cutting edge at the intersection of the web thinning gash and the primary relief surface of the top surface, the second leading cutting edge being continuous with the first leading cutting edge.

These and other aspects of the present invention will be more fully understood following a review of this specification and drawings.

DETAILED DESCRIPTION

The following description is for purposes of illustrating various aspects of the invention only and not for purposes of limiting the scope of the invention.

Figure 1:
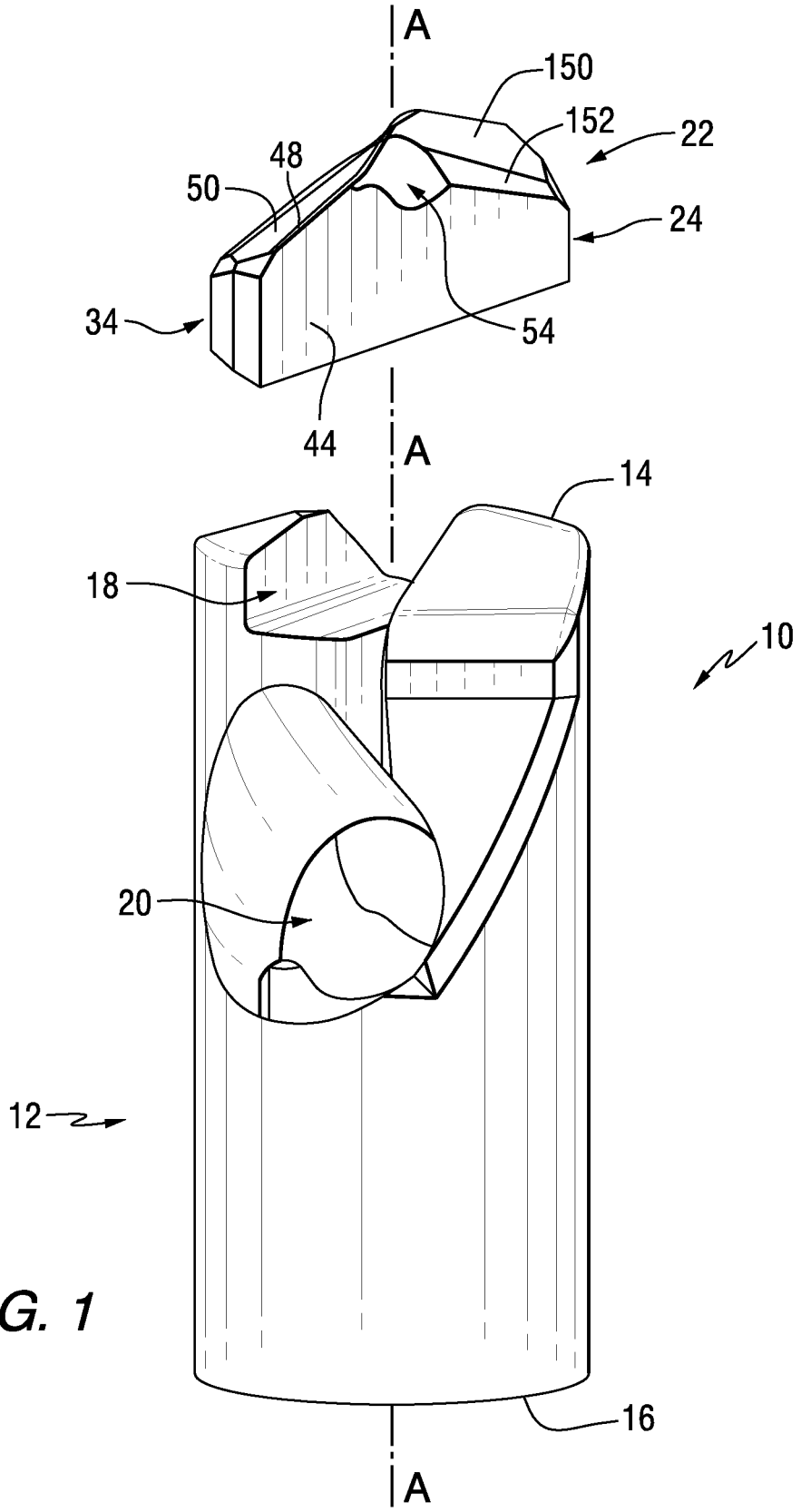
FIG. 1 is an exploded view of rotary drill bit, e.g. a roof drill bit, in accordance with an aspect of the invention.
Figure 2:
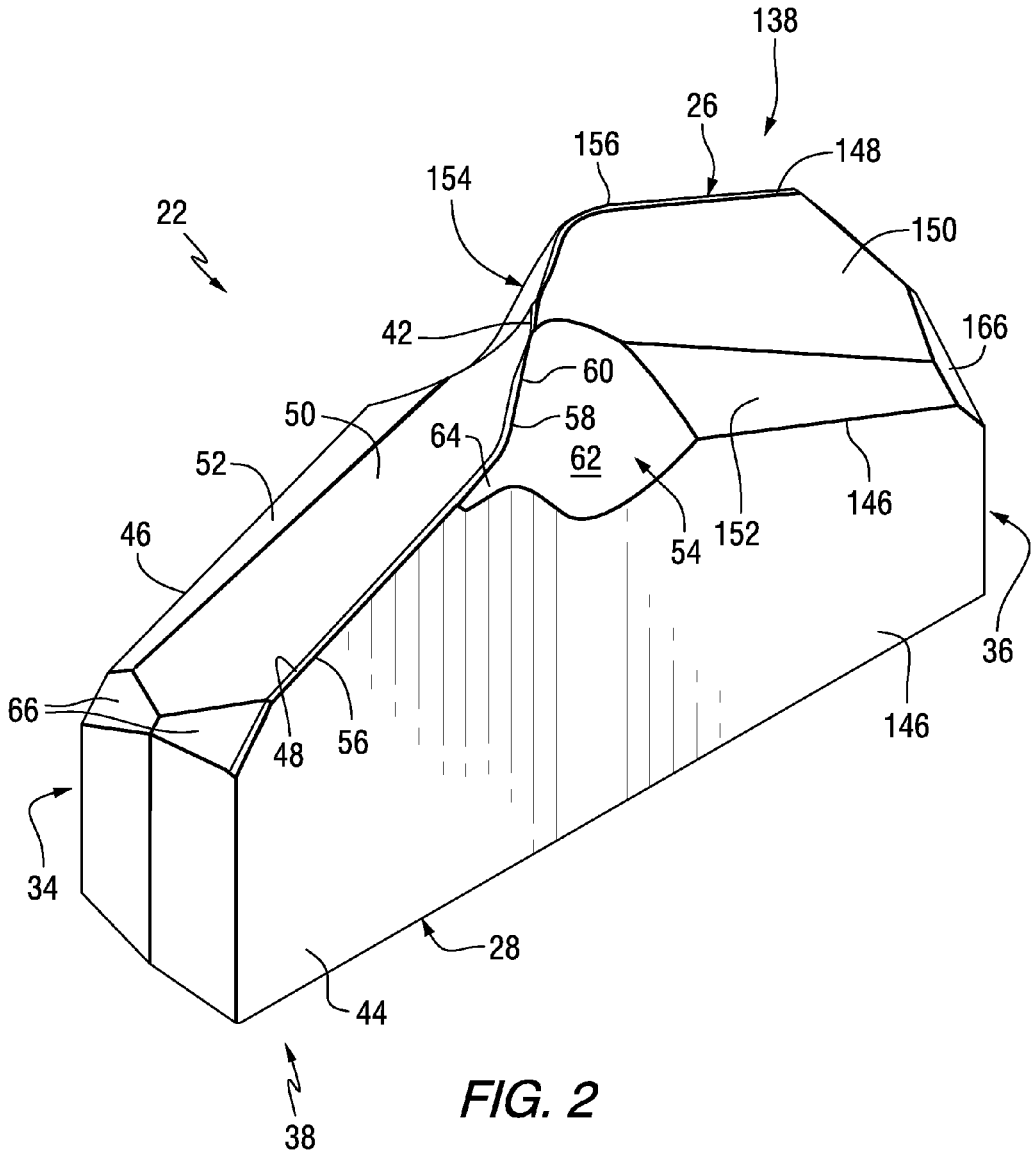
FIG. 2 is an isometric view of a cutting insert shown in FIG. 1, in accordance with an aspect of the invention.
Figure 3:
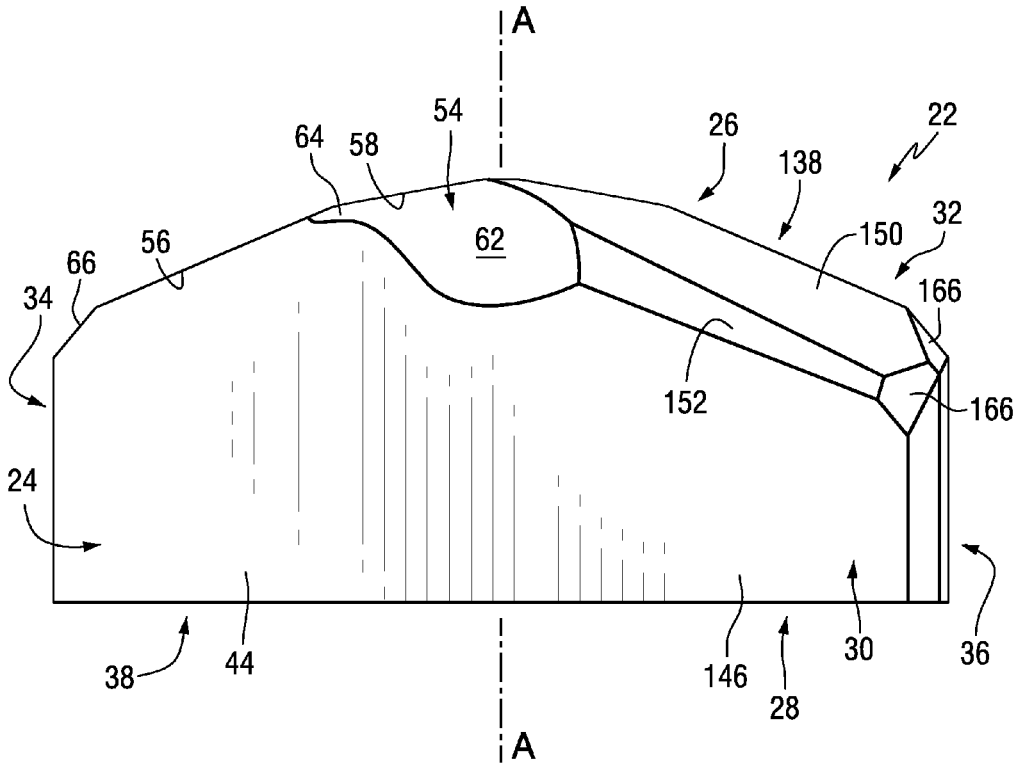
FIG. 3 is a front view of the cutting insert shown in FIG. 2, in accordance with an aspect of the invention.

Referring to the drawings, FIG. 1 illustrates a rotary drill bit in the form of a roof drill bit generally designated as 10. Roof drill bit 10 has an elongate drill bit body 12 typically made of, for example, steel. Drill bit body 12 presents a generally cylindrical geometry. Drill bit body 12 has an axial forward end 14 and an axial rearward end 16. Drill bit body 12 contains a transverse slot 18 in the axial forward end thereof 14. Drill bit body 12 also contains a debris evacuation or collection port 20 that is mediate between the axial forward end 14 and the axial rearward end 16. During the drilling operation, dirt and debris may pass through the port 20.

The roof drill bit 10 also includes a cutting insert (or rotary drill bit insert) 22 (see FIGS. 1-6) that is positioned within the transverse slot 18 and is typically affixed therein mechanically or otherwise, via brazing, gluing, or press fitting using conventional compositions and techniques known to those skilled in the art. The roof drill bit 10 and the cutting insert 22 have a central axis A-A wherein the roof drill bit 10 and the cutting insert 22 are rotatable about the central axis A-A. The cutting insert 22 is made from, for example, a cemented tungsten carbide that is a mixture of cobalt and tungsten carbide. Other super hard wear resistant materials such as polycrystalline diamond, ceramics, or cermet may be used as a supplement and/or substitute. For example chromium carbide-coated metals and other cermets where titanium carbide or vanadium carbide added to tungsten carbide may be candidates for insert materials here under. And alternate ceramics for such applications include aluminum-based, silicon based, zirconium-based and glass varieties. Still others insert materials alternatives include cubic refractory, transition metal carbides or any other known or subsequently developed material(s) harder than the base material. Also coatings of the inserts such as PVD or CVD coatings can be used.

Cutting insert 22 has a cutting insert body, generally designated as 24, that has a top surface generally designated as 26, a bottom surface generally designated as 28, opposite side surfaces generally designated as 30 and 32, and opposite end surfaces generally designated as 34 and 36. The cutting insert body 24 is structured and arranged into two opposite symmetric connected portions, i.e. a pair of symmetrical halves, which are symmetric about the central axis A-A; namely, one symmetric portion generally designated by bracket 38 and another symmetric portion generally designated by bracket 138.

The cutting insert 22 also includes a chisel edge 42 centrally located on the top surface 26 and containing the central rotational axis A-A. In one aspect, the cutting insert 22 can also be structured and arranged so as to be symmetrical about the chisel edge 42, i.e. to provide or divide the cutting insert 22 into two opposite symmetric connected portions or a pair of symmetrical halves generally similar to or the same as the symmetrical halves 38 and 138.

Referring to the one symmetric portion 38, there is a leading face 44 and an opposite trailing face 46. In one aspect, the top surface 26 includes a primary relief surface 48 adjacent to the leading face 44. In another aspect, the top surface 26 also includes a secondary relief surface 50 wherein the primary relief surface 48 and the secondary relief surface 50 are contiguous and non-coplanar. In another aspect, the top surface 26 further includes a tertiary relief surface 52 wherein the secondary relief surface 50 and the tertiary relief surface 52 are contiguous and non-coplanar.

In accordance with another aspect of the invention, the symmetric portion 38 of the cutting insert 22 includes a web thinning gash, generally designated as 54, extending generally between the leading face 44 and the primary relief surface 48 of the top surface 26. In one aspect, the web thinning gash 54 is centrally located on the cutting insert body 24, e.g. adjacent or proximate to the central axis A-A.

The symmetric portion 38 of the cutting insert 22 further includes a first leading cutting edge 56 at the intersection of the leading face 44 and the primary relief surface 48 of the top surface 26. In addition, the cutting insert 22 further includes a second leading cutting edge 58 at the intersection of a face 60 of the web thinning gash 54 and the primary relief surface 48 of the top surface 26. In one aspect, the second leading cutting edge 58 is continuous with the first leading cutting edge 56.

In one aspect, the web thinning gash 54 is generally S-shaped, but it will be appreciated that variations or other similar shapes and configurations may be provided in accordance with the invention. In another aspect, the second leading cutting edge 58 is generally S-shaped, but it will be appreciated that variations or other similar shapes and configurations may be provided in accordance with the invention.

The web thinning gash 54 includes a debris evacuation portion, generally designated as 62, and a distal transition portion 64 disposed adjacent the debris evacuation portion 62, in accordance with an aspect of the invention. In one aspect, the debris evacuation portion 62 is centrally disposed adjacent the central axis A-A. In another aspect, the debris evacuation portion 62 of the web thinning gash 54 is structured and arranged for directing the earth strata material that is removed during a drilling operation toward the debris evacuation port 20 of the elongate drill bit body 12. For example, the debris evacuation portion 62 includes an arcuate or web shaped construction that efficiently allows for the earth strata material to be conveyed or directed away from the cutting edges 56 and 58. Advantageously, this allows for the more efficient operation of the roof drill bit 10 and, more particularly, for the more efficient operation of the cutting insert 22.

As described, the web thinning gash 54 also includes the distal transition portion 64 disposed adjacent the debris evacuation portion 62. The distal transition portion 64 provides for a smooth transition between the web thinning gash 54 and the leading face 44. The distal transition portion 64 is structured and arranged so as to narrow or taper as the web thinning gash 54 moves generally away from the central axis A-A and moves generally toward the end 34 of the insert body 24. The illustrated gradual narrowing or tapering of the distal transition portion 64 advantageously avoids a sharp transition so as to reduce or minimize the possibility of the leading cutting edges 56 and/or 58 breaking or chipping during operation of the roof drill bit 10. The web thinning gash 54 incorporates a changing rake angle across its form. Advantageously, this reduces chipping at the intersection with the main cutting edge 56 while reducing the thrust force generated at the bit's center.

Figure 4:
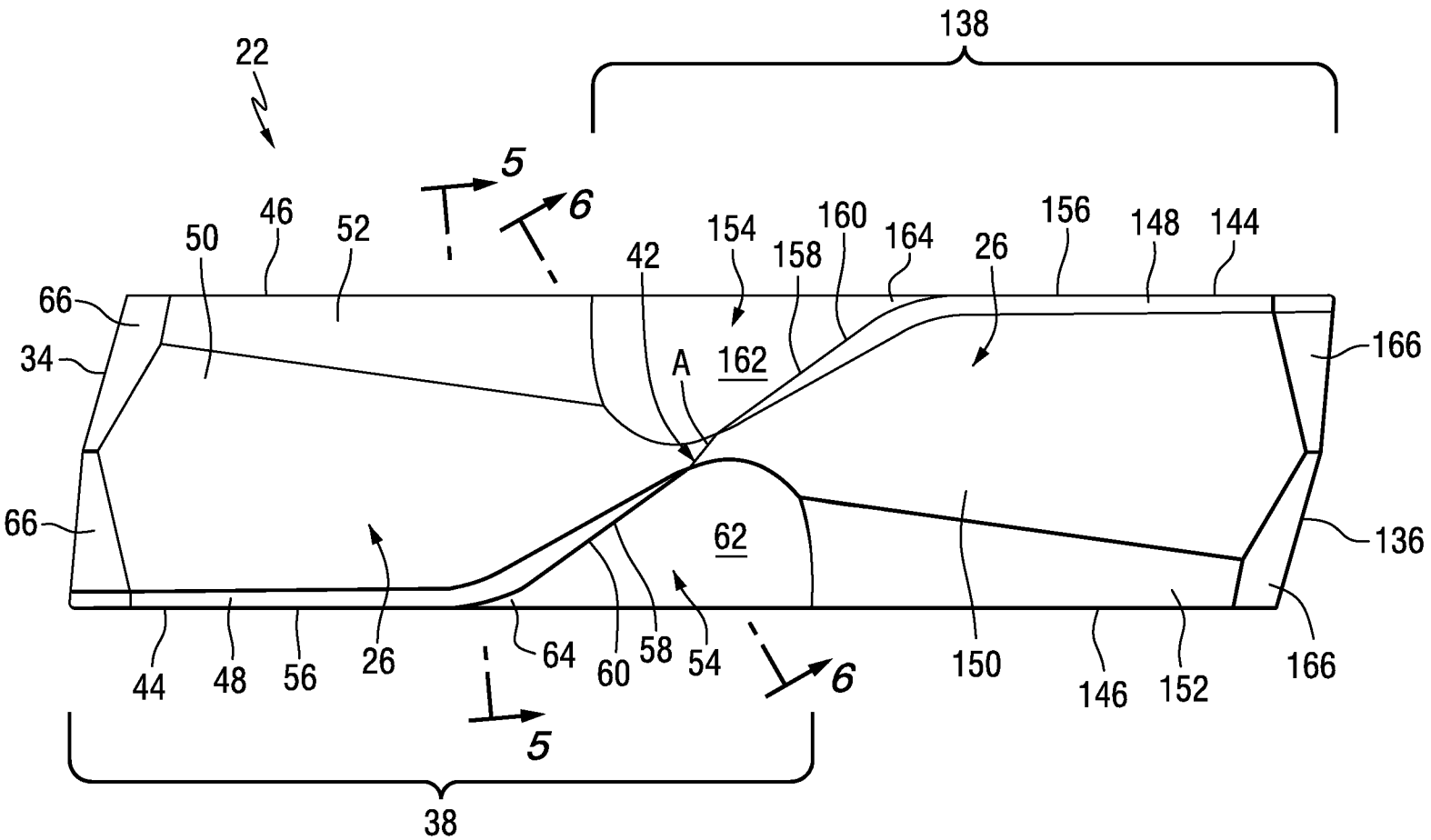
FIG. 4 is a top view of the cutting insert shown in FIGS. 2 and 3, in accordance with an aspect of the invention.
Figure 5:
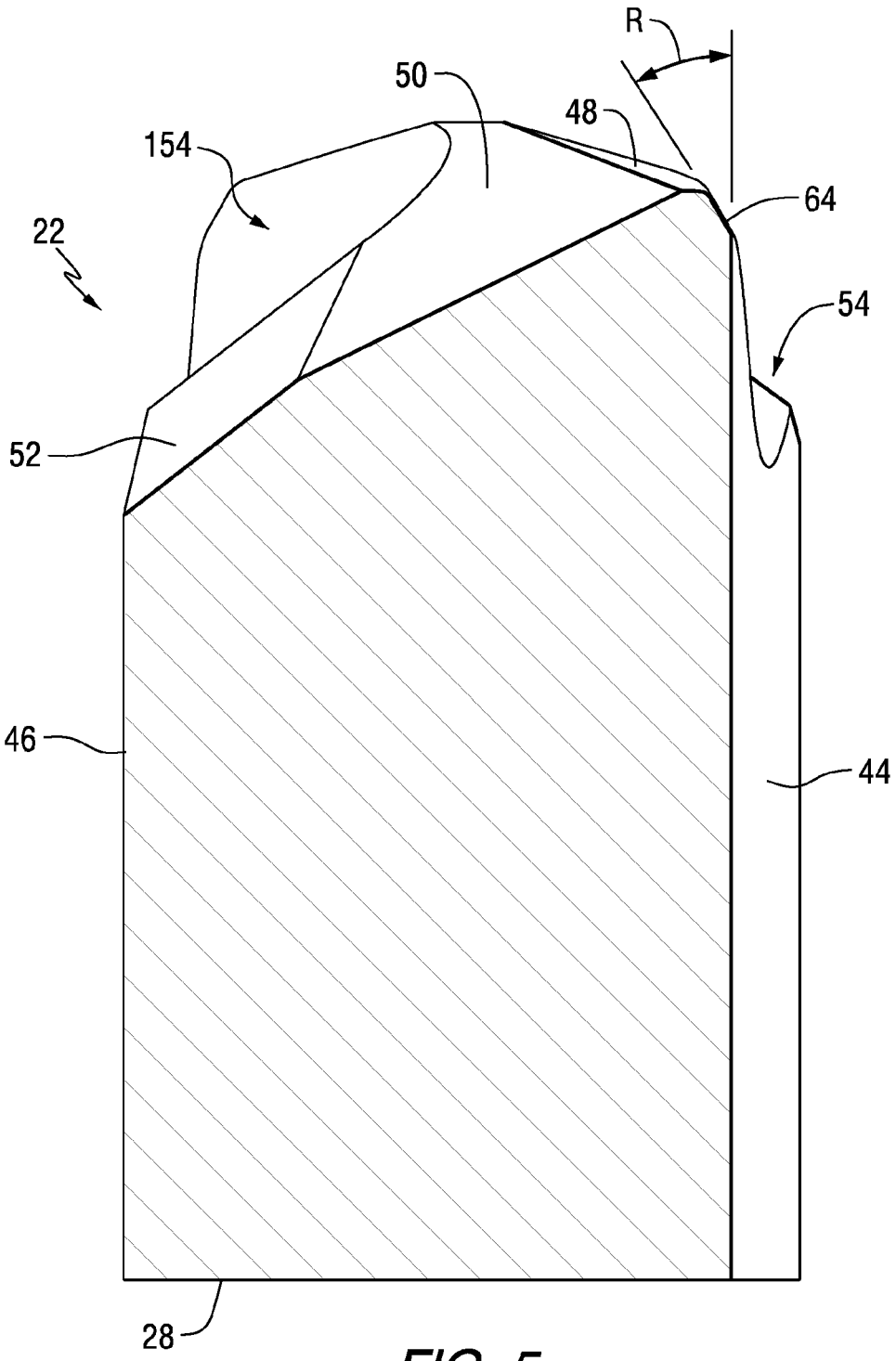
FIG. 5 is a sectional view taken along line 5-5 of FIG. 4, in accordance with another aspect of the invention.
Figure 6:
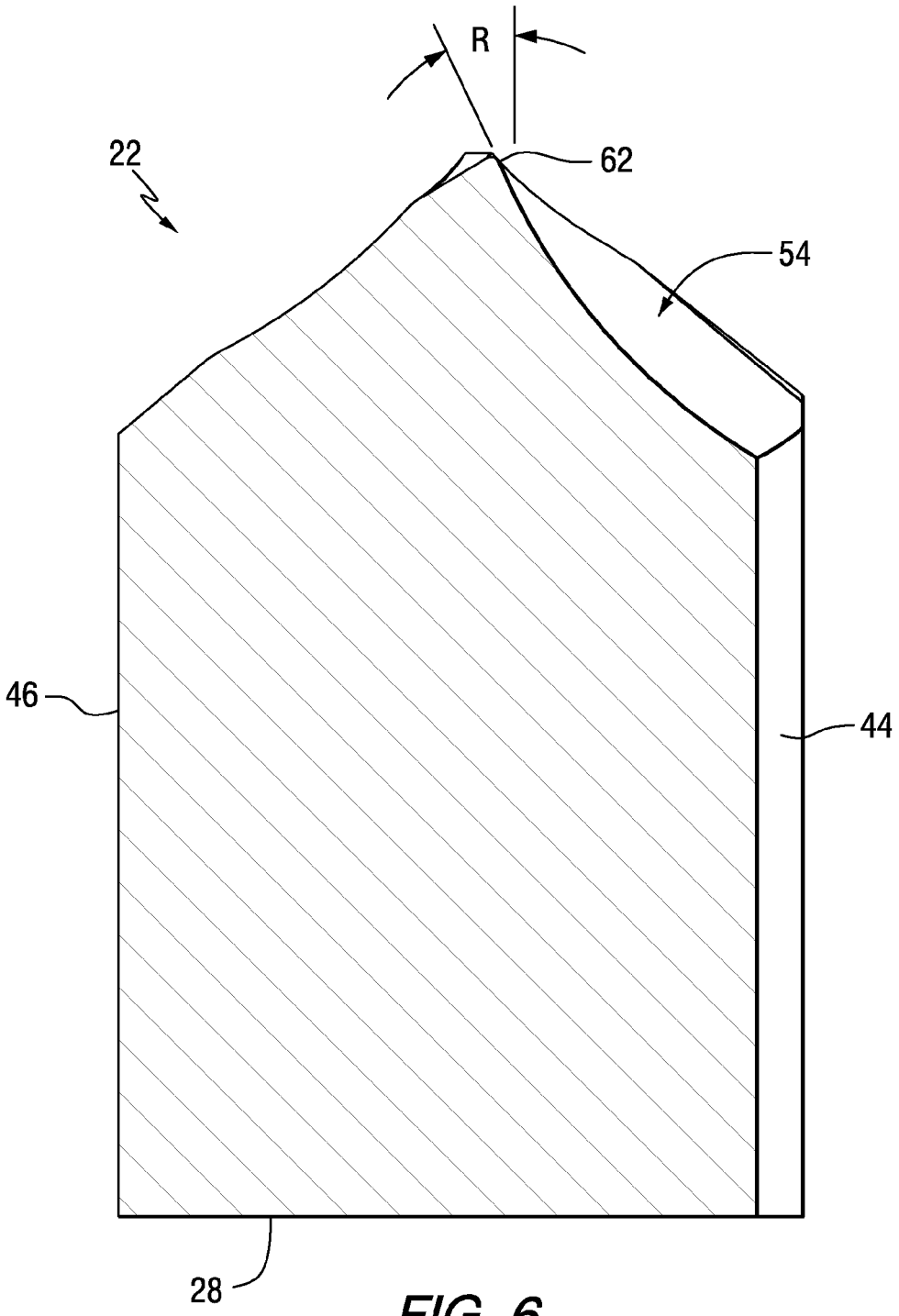
FIG. 6 is a sectional view taken along line 6-6 of FIG. 4, in accordance with another aspect of the invention.

Referring to FIGS. 4-6, the web thinning gash 54 defines a zero to negative rake angle R at the second leading cutting edge 58. Advantageously, the zero to negative rake angle increases the strength of the cutting insert 22 particularly in the area or region adjacent to or proximate to the central axis A-A and the chisel edge 42. In one aspect, the rake angle R is in the range of about 0 degrees to about negative 60 degrees. In another aspect, the web thinning gash defines a rake angle that is in the range of about negative 20 degrees to about negative 40 degrees. In one specific example, the rake angle R shown in FIG. 5 is about negative 30 degrees and in another specific example shown in FIG. 6 is about negative 25 degrees. In one aspect, the rake angle R may vary along the length of the second leading cutting edge 58. In another aspect, a rake angle of the first leading cutting edge 56 may be, for example, about 0 degrees.

Cutting insert 22 is made, for example, with a powder metallurgy process using a press comprising of a die and top and bottom ram/punch to press the complete shape. Parts can be pressed to finished shape or modified with a wet/dry blast, or diamond ground other material shaping processes such as but not limited to EDM (electrical discharge machining), EDG (electrical discharge grinding), green machining, laser ablation into final shapes.

In another aspect of the invention, one or more chamfers 66 may be provided where the end surface 34 meets the top surface 26. Advantageously, the chamfer(s) 66 (or radius) serve to avoid a sharp transition so as to reduce or minimize the possibility of the edges breaking or chipping during operation of the roof drill bit 10.

Referring to the other symmetric portion 138, there is a leading face 144 and an opposite trailing face 146. In one aspect, the top surface 26 includes a primary relief surface 148 adjacent to the leading face 144. In another aspect, the top surface 26 also includes a secondary relief surface 150 wherein the primary relief surface 148 and the secondary relief surface 150 are contiguous and non-coplanar. In another aspect, the top surface 26 further includes a tertiary relief surface 152 wherein the secondary relief surface 150 and the tertiary relief surface 152 are contiguous and non-coplanar.

In accordance with another aspect of the invention, the symmetric portion 138 of the cutting insert 22 includes a web thinning gash, generally designated as 154, extending generally between the leading face 144 and the primary relief surface 148 of the top surface 26. In one aspect, the web thinning gash 154 is centrally located on the cutting insert body 24, e.g. adjacent or proximate to the central axis A-A.

The symmetric portion 138 of the cutting insert 22 further includes a first leading cutting edge 156 at the intersection of the leading face 144 and the primary relief surface 148 of the top surface 26. In addition, the cutting insert 22 further includes a second leading cutting edge 158 at the intersection of a face 160 of the web thinning gash 154 and the primary relief surface 148 of the top surface 26. In one aspect, the second leading cutting edge 158 is continuous with the first leading cutting edge 156.

In one aspect, the web thinning gash 154 is generally S-shaped, but it will be appreciated that variations or other similar shapes and configurations may be provided in accordance with the invention. In another aspect, the second leading cutting edge 158 is generally S-shaped, but it will be appreciated that variations or other similar shapes and configurations may be provided in accordance with the invention.

The web thinning gash 154 includes a debris evacuation portion, generally designated as 162, and a distal transition portion 164 disposed adjacent the debris evacuation portion 162, in accordance with an aspect of the invention. In one aspect, the debris evacuation portion 162 is centrally disposed adjacent the central axis A-A. In another aspect, the debris evacuation portion 162 of the web thinning gash 154 is structured and arranged for directing the earth strata material that is removed during a drilling operation toward an additional debris evacuation port of the elongate drill bit body 12. For example, the debris evacuation portion 162 includes an arcuate or web shaped construction that efficiently allows for the earth strata material to be conveyed or directed away from the cutting edges 156 and 158. Advantageously, this allows for the more efficient operation of the roof drill bit 10 and, more particularly, for the more efficient operation of the cutting insert 22.

As described, the web thinning gash 154 also includes the distal transition portion 164 disposed adjacent the debris evacuation portion 162. The distal transition portion 164 provides for a smooth transition between the web thinning gash 154 and the leading face 144. The distal transition portion 164 is structured and arranged so as to narrow or taper as the web thinning gash 154 moves generally away from the central axis A-A and moves generally toward the end 36 of the insert body 24. The illustrated gradual narrowing or tapering of the distal transition portion 164 advantageously avoids a sharp transition so as to reduce or minimize the possibility of the leading cutting edges 156 and/or 158 breaking or chipping during operation of the roof drill bit 10.

Referring to FIGS. 4-6, the web thinning gash 154 defines a zero to negative rake angle (for example, same as angle R described herein for symmetric portion 38) at the second leading cutting edge 158. Advantageously, the zero to negative rake angle increases the strength of the cutting insert 22 particularly in the area or region adjacent to or proximate to the central axis A-A and the chisel edge 42. In one aspect, the rake angle is in the range of about 0 degrees to about negative 60 degrees. In another aspect, the web thinning gash defines a rake angle that is in the range of about negative 20 degrees to about negative 40 degrees. In one specific example, the rake angle (similar to as shown in FIG. 5) is about negative 30 degrees and in another specific example (similar to as shown in FIG. 6) is about negative 25 degrees. In one aspect, the rake angle may vary along the length of the second leading cutting edge 158. In another aspect, a rake angle of the first leading cutting edge 156 may be, for example, about 0 degrees.

Figure 7:
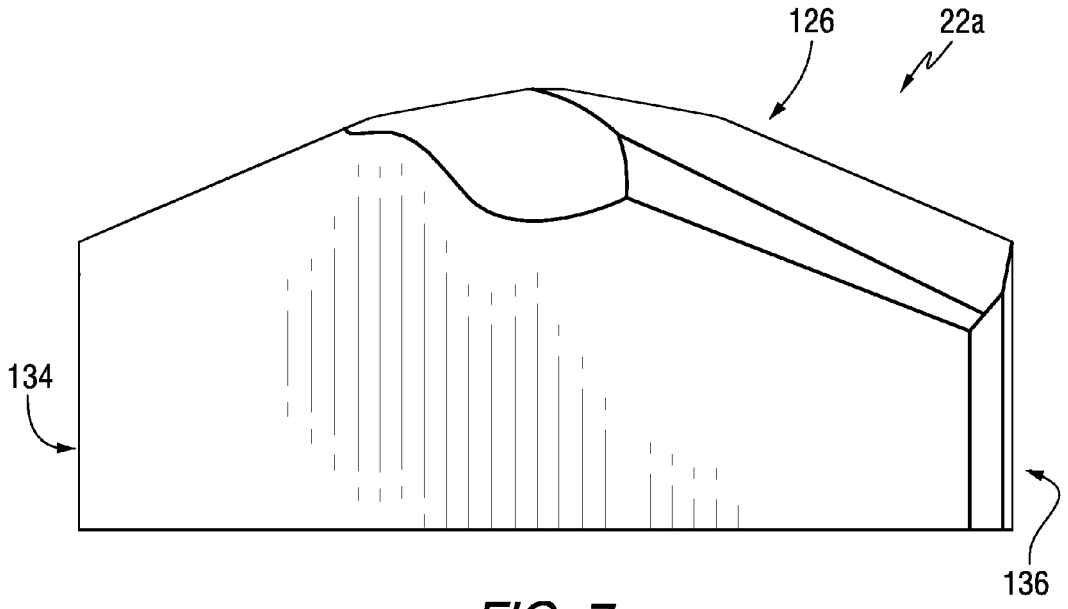
FIG. 7 is a front view of an additional cutting insert, in accordance with an aspect of the invention

In another aspect of the invention, one or more chamfers 166 (or radius) may be provided where the end surface 36 meets the top surface 26. Advantageously, the chamfer(s) 166 serve to avoid a sharp transition so as to reduce or minimize the possibility of the edges breaking or chipping during operation of the roof drill bit 10. Alternatively, FIG. 7 illustrates an additional cutting insert **22*a*, similar to cutting insert 22, but not having chamfers 66 or 166 where end surfaces 134 and 136 meet top surface 126**.

Whereas particular aspects of this invention have been described above for purposes of illustration, it will be evident to those skilled in the art that numerous variations of the details of the present invention may be made without departing from the invention as defined in the appended claims.

What is claimed is:

1. A rotary drill bit for engaging an earth strata material, the rotary drill bit comprising:

an elongate drill bit body having an axial forward end and an axial rearward end; and a cutting insert attached to the axial forward end of the elongate drill bit body, the cutting insert having an elongate insert body rotatable about a central axis, the elongate insert body having a pair of symmetrical halves symmetrical about the central axis, each symmetrical half comprising:

a leading face;

a top surface having a primary relief surface;

a web thinning gash extending between the leading face and the primary relief surface of the top surface, the web thinning gash having a debris evacuation portion centrally disposed adjacent the central axis and a distal transition portion disposed adjacent the debris evacuation portion;

a first leading cutting edge at the intersection of the leading face and the primary relief surface of the top surface; and a second leading cutting edge at the intersection of the web thinning gash and the primary relief surface of the top surface, the second leading cutting edge being continuous with the first leading cutting edge, wherein the web thinning gash defines a negative rake angle at the second leading cutting edge.

2. The rotary drill bit of claim 1, wherein the web thinning gash defines the rake angle in the range of about 0 degrees to about negative 60 degrees.

3. The rotary drill bit of claim 1, wherein the web thinning gash defines the rake angle in the range of about negative 20 degrees to about negative 40 degrees.

4. The rotary drill bit of claim 1, wherein the top surface includes a secondary relief surface wherein the primary relief surface and the secondary relief surface are contiguous and non-coplanar, and wherein the top surface further includes a tertiary relief surface wherein the secondary relief surface and the tertiary relief surface are contiguous and non-coplanar.

5. The rotary drill bit of claim 4, wherein each symmetrical half further includes an end surface adjacent the leading face and the top surface and a chamfer formed between the end surface and the top surface.

6. The rotary drill bit of claim 1, wherein the web thinning gash is generally S-shaped.

7. The rotary drill bit of claim 1, wherein the second leading cutting edge is generally S-shaped.

8. The rotary drill bit of claim 1, wherein the elongate drill bit body includes a debris evacuation port mediate of the axial forward end and the axial rearward end thereof.

9. The rotary drill bit of claim 8, wherein the debris evacuation portion of the web thinning gash is structured and arranged for directing the earth strata material toward the debris evacuation port of the elongate drill bit body.

10. A cutting insert for use in connection with a rotary drill bit for engaging an earth strata material, the cutting insert comprising:

an elongate insert body rotatable about a central axis, the elongate insert body having a pair of symmetrical halves symmetrical about the central axis, each symmetrical half comprising:

a leading face;

a top surface having a primary relief surface;

a web thinning gash extending between the leading face and the primary relief surface of the top surface, the web thinning gash having a debris evacuation portion centrally disposed adjacent the central axis and a distal transition portion disposed adjacent the debris evacuation portion;

a first leading cutting edge at the intersection of the leading face and the primary relief surface of the top surface; and a second leading cutting edge at the intersection of the web thinning gash and the primary relief surface of the top surface, the second leading cutting edge being continuous with the first leading cutting edge, wherein the web thinning gash defines a negative rake angle at the second leading cutting edge.

11. The rotary drill bit of claim 10, wherein the web thinning gash defines the rake angle in the range of about negative 20 degrees to about negative 40 degrees.

12. The cutting insert of claim 10, wherein the top surface further includes a secondary relief surface wherein the primary relief surface and the secondary relief surface are contiguous and non-coplanar.

13. The cutting insert of claim 12, wherein the top surface further includes a tertiary relief surface wherein the secondary relief surface and the tertiary relief surface are contiguous and non-coplanar.

14. The cutting insert of claim 10, wherein each symmetrical half further includes an end surface adjacent the leading face and the top surface.

15. The cutting insert of claim 14, including a chamfer formed between the end surface and the top surface.

16. The cutting insert of claim 10, wherein the web thinning gash is generally S-shaped.

17. The cutting insert of claim 10, wherein the second leading cutting edge is generally S-shaped.

18. A cutting insert for use in connection with a rotary drill bit for engaging an earth strata material, the cutting insert comprising:

an elongate insert body rotatable about a central axis, the elongate insert body having a pair of symmetrical halves symmetrical about the central axis, each symmetrical half comprising:

a leading face;

a top surface having a primary relief surface;

a web thinning gash extending between the leading face and the primary relief surface of the top surface, the web thinning gash having a debris evacuation portion centrally disposed adjacent the central axis and a distal transition portion disposed adjacent the debris evacuation portion;

a first leading cutting edge at the intersection of the leading face and the primary relief surface of the top surface; and a second leading cutting edge at the intersection of the web thinning gash and the primary relief surface of the top surface, the second leading cutting edge being continuous with the first leading cutting edge, wherein the web thinning gash defines a rake angle that is in the range of about 0 degrees to about negative 60 degrees.

* * * * *